US007140842B2

(12) United States Patent
Liu

(10) Patent No.: US 7,140,842 B2
(45) Date of Patent: Nov. 28, 2006

(54) AXIAL FLOW FAN

(75) Inventor: Wen-Hao Liu, Taipei (TW)

(73) Assignee: Asis Vital Component Co., Ltd., Kaohsiung (TW)

( * ) Notice: Subject to any disclaimer, the term of this patent is extended or adjusted under 35 U.S.C. 154(b) by 128 days.

(21) Appl. No.: 10/813,092

(22) Filed: Mar. 31, 2004

(65) Prior Publication Data

US 2005/0220608 A1 Oct. 6, 2005

(51) Int. Cl.
*F04D 29/70* (2006.01)

(52) U.S. Cl. ..... 416/247 R; 415/220; 415/226

(58) Field of Classification Search ..... 415/121.2, 415/220, 225, 226; 416/247 R
See application file for complete search history.

(56) References Cited

U.S. PATENT DOCUMENTS 6,481,963 B1 * 11/2002 Lin et al. ..... 415/220
D489,441 S * 5/2004 Wagner ..... D23/370
6,869,269 B1 * 3/2005 Huang et al. ..... 415/116

FOREIGN PATENT DOCUMENTS

JP 02298697 A * 12/1990

* cited by examiner

*Primary Examiner*—Edward K. Look
*Assistant Examiner*—Dwayne J White

(57) ABSTRACT

An axial flow fan includes a frame, a driving device and a fan blade part. The driving device is disposed in the frame and the fan blade part provides a hub member and a plurality of fan blades attached to the outer rim of the hub member and the hub member engaging with the driving device. It is characterized in that the fan blades are disposed outside the frame and the lower edges of the fan blades are flush with or higher than the upper edge of the frame.

1 Claim, 3 Drawing Sheets

AXIAL FLOW FAN

BACKGROUND OF THE INVENTION

1. Field of the Invention

The present invention is related to an axial flow fan and particularly to an axial flow fan, which is capable of increasing flow rate and air pressure.

2. Brief Description of the Related Art

Taiwanese Patent Publication No. 540641 discloses an axial flow type blowing device, entitled "AXIAL FLOW TYPE BLOWING DEVICE FOR INCREASING AIR PRESSURE AND FLOW RATE OF OUTPUT FLUID", which includes an outer frame base, a rotary device, a fan blade device and an outer frame. The outer frame base has an inlet and an outlet being disposed at two lateral sides thereof respectively. The rotary device is used for driving the blowing device and the fan blade device further includes a hub, a plurality of blades and a plurality of thin flow gain plates. While the rotary device rotates with a preset speed to drive the fan blade device, the thin flow gain plates increase the contact area of the blades with the fluid so as to increase flow rate at the inlet.

However, the thin flow gain plates on the blades of the preceding axial type fan provide limited effect due to the sizes thereof being unable to increase and rotation of the fan blade device being affected so that the flow rate and the air pressure is not much increased even if the thin flow gain plates are provided.

SUMMARY OF THE INVENTION

An object of the present invention is to provide an axial flow fan in which the fan blades are disposed outside the frame thereof.

BRIEF DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE PREFERRED EMBODIMENT

Figure 1:
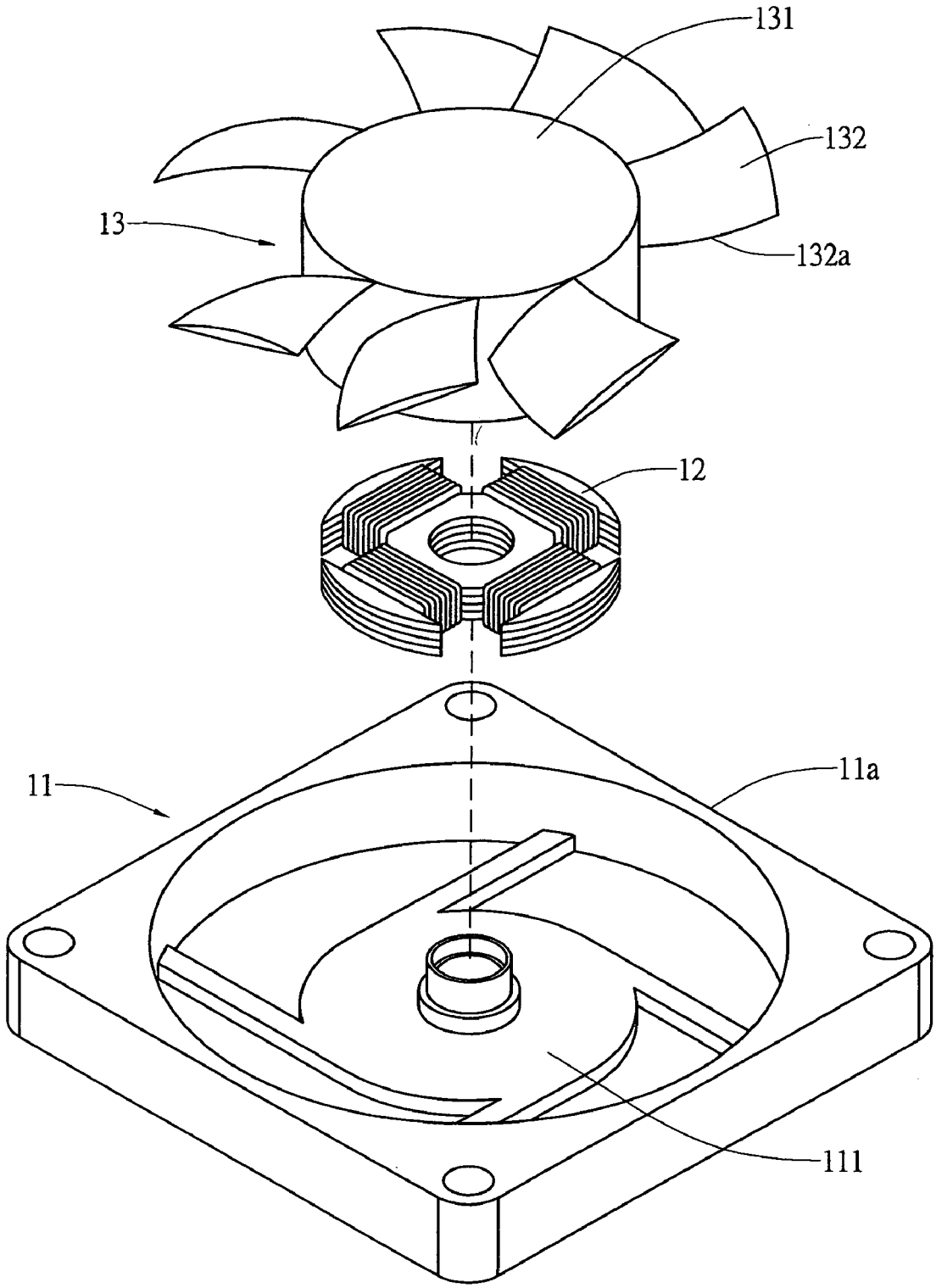
FIG. 1 is an exploded perspective view of a first embodiment according to the present invention.
Figure 2:
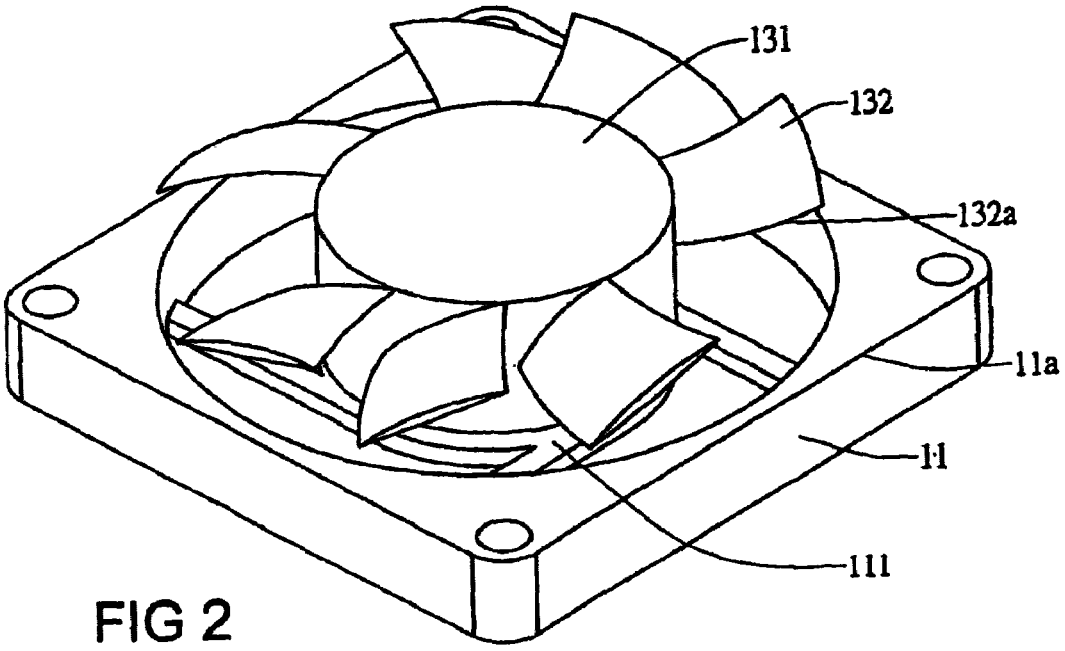
FIG. 2 is an assembled perspective view of the first embodiment shown in FIG. 1.

Referring to FIGS. 1 and 2, an axial flow fan of the first embodiment according to the present invention includes a frame 11, a driving device 12 and fan blade part 13. The driving device 12 is fixedly attached to a support part 111 of the frame 11. The fan blade part 13 includes a hub member and a plurality of fan blades 132 disposed around the hub member 12. The hub member 131 engages with the driving device 12.

When the axial flow fan is assembled, the hub member 131 is movably connected to the driving device 12 and the fan blade part 13 is movably connected to the frame 11. The fan blades 132 of the fan blade part 13 are disposed outside the frame 11 and lower edges of the fan blades are flush with the upper edge of the frame 11.

Figure 4:
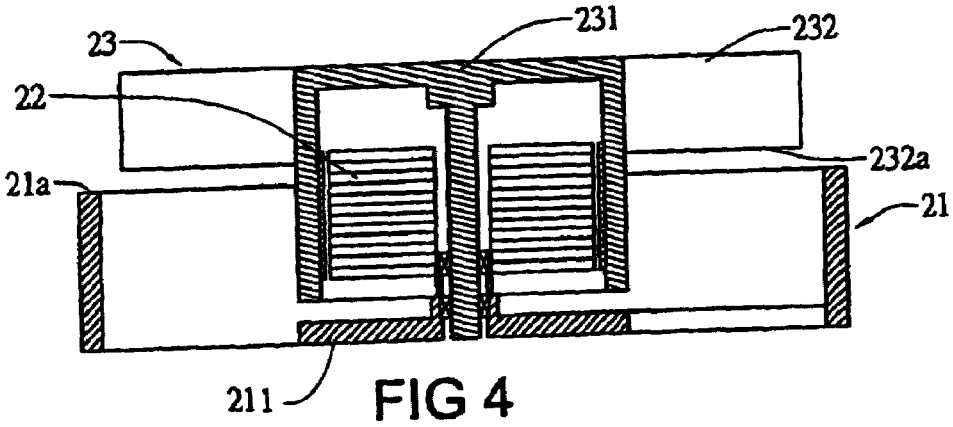
FIG. 4 is a side sectional view of a second embodiment according to the present invention.

Referring to FIGS. 4, a second embodiment of the present invention includes a frame 21, a driving device 22 and a fan blade part 23. The driving device 22 is disposed on the support part 211 of the frame 21. The fan blade part 23 includes a hub member 231 and a plurality of fan blades 232 around the hub member 231. The hub member 231 engages with the driving device 22.

When the axial flow fan is assembled, the hub member 231 is movably connected to the driving device 22 and the fan blade part 23 is movably connected to the frame 21. The fan blades 232 of the fan blade part 23 are disposed outside the frame 21 and lower edges **232*a* of the fan blades 232 are flush with the upper edge 21*a* of the frame 21**.

Figure 3:
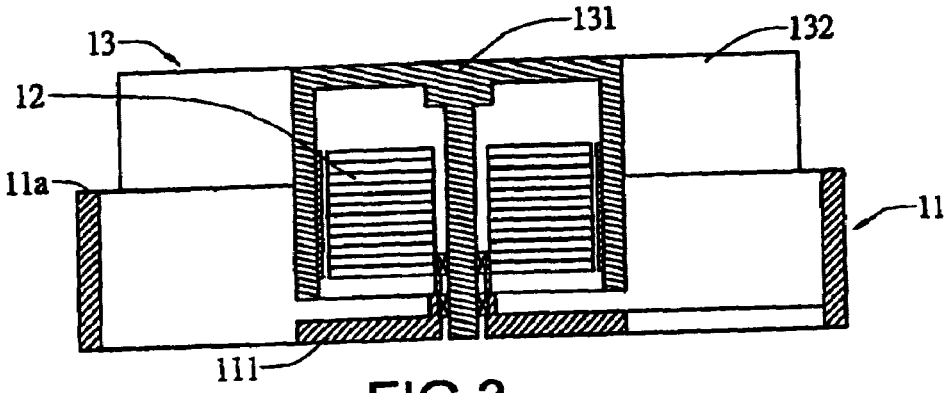
FIG. 3 is a side sectional view of the first embodiment shown in FIG. 2.

Referring to FIG. 3 in company with FIG. 4, the fan blades 132, 232 of the fan blade part 13, 23 are disposed outside the frames 11, 21 so that it can be reached to a greatest area for the fan blades 132, 232 to contact with fluid and it is possible for the air surrounding the fan blade part 13, 23 to be utilized sufficiently.

Figure 5:
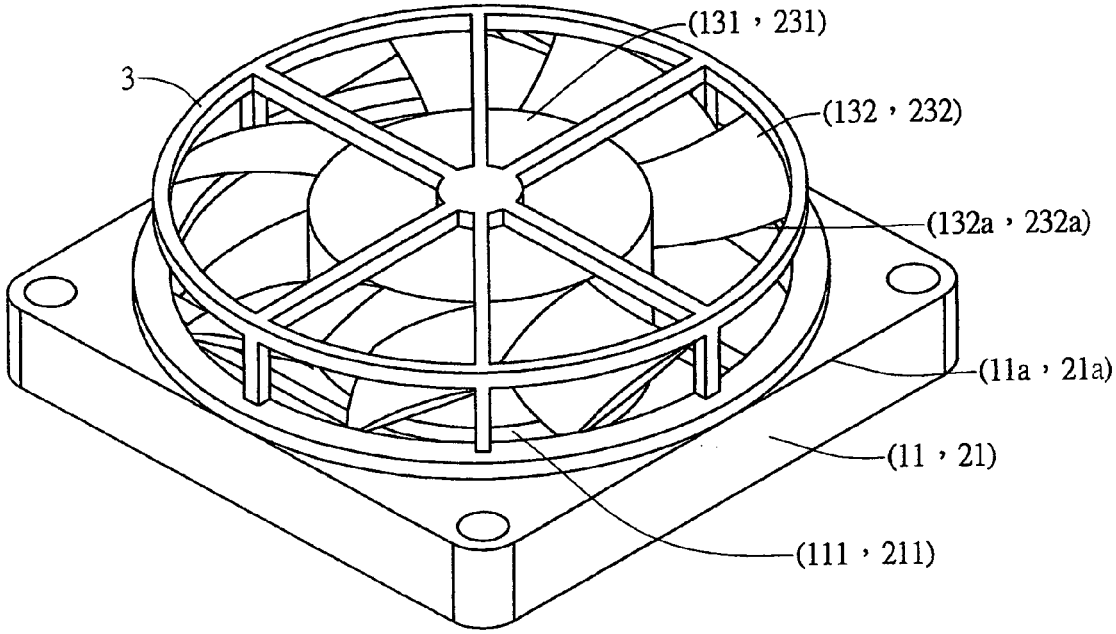
FIG. 5 is a perspective view of a frame being added with a shield member as an integral piece.
Figure 6:
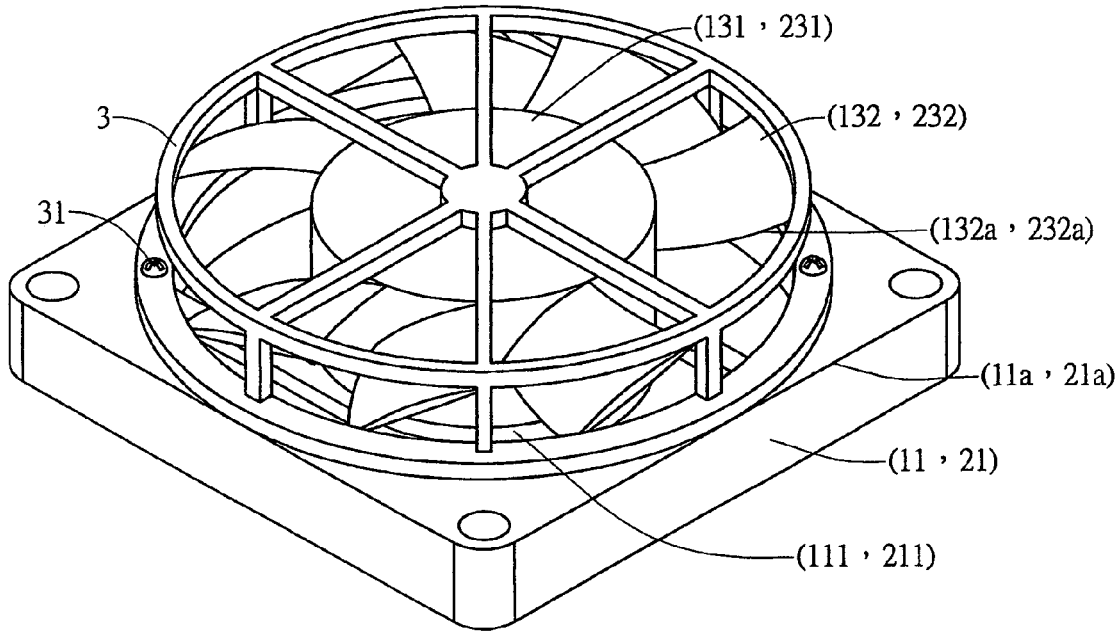
FIG. 6 is a perspective view of a frame being attached with a shield member by way of assembling.

Referring to FIGS. 5 and 6, the frames 11, 21 can be added with a shield member 3 to enclose the fan blades 132, 232 outside the frames 11, 21 and the fan blade parts 13, 23 as a safety guard respectively. Further, there are following two ways for join the frames 11, 21 and the shield member 3:

Referring to FIG. 5 again, the frames 11, 21 are made with the shield member 3 as a single unit, that is, the frames 11, 21 engage with the shield 3 during fabrication.

Referring to FIG. 5, the frames 11, 21 are made with the shield 3 as a single unit, that is, the frames 11, 21 engage with the shield 3 during fabrication.

Referring to FIG. 6, again the shield 3 is attached to the frames 11, 21 by way of built-up, that is, the shield 3 can be attached to the frames 11, 21 by way of screw fastening components 31.

While the invention has been described with referencing to preferred embodiments thereof, it is to be understood that modifications or variations may be easily made without departing from the spirit of this invention, which is defined by the appended claims.

What is claimed is:

1. An axial flow fan, comprising a frame;

a driving device, being disposed in the frame; and a fan blade part, providing a hub member and a plurality of fan blades attached to an outer rim of the hub member and the hub member engaging with the driving device such that the fan blades are disposed outside the frame and the lower edges of the fan blades are flush with upper edge of the frame; and a shield member, being joined to the frame to surround the fan blades;

characterized in that the shield member is built-up to the frame with screw fasteners.

* * * * *